US008152209B2

(12) United States Patent
Lee

(10) Patent No.: US 8,152,209 B2
(45) Date of Patent: Apr. 10, 2012

(54) DELAY APPARATUS FOR OPENING OF VEHICLE DOOR

(75) Inventor: Joel R. Lee, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 478 days.

(21) Appl. No.: 12/388,668

(22) Filed: Feb. 19, 2009

(65) Prior Publication Data

US 2009/0243307 A1 Oct. 1, 2009

Related U.S. Application Data

(60) Provisional application No. 61/040,771, filed on Mar. 31, 2008.

(51) Int. Cl.
*E05B 3/00* (2006.01)
*E05B 65/10* (2006.01)

(52) U.S. Cl. ..... 292/336.3; 292/DIG. 22; 292/DIG. 65

(58) Field of Classification Search ..... 292/92, 292/93, 336.3, DIG. 22, DIG. 65, DIG. 62
See application file for complete search history.

(56) References Cited

U.S. PATENT DOCUMENTS

| | | | | |
|---|---|---|---|---|
| 4,342,209 | A * | 8/1982 | Kleefeldt | 70/264 |
| 4,723,454 | A * | 2/1988 | Periou et al. | 74/89.25 |
| 5,037,145 | A * | 8/1991 | Wilkes | 292/201 |
| 5,769,471 | A * | 6/1998 | Suzuki et al. | 292/336.3 |
| 7,201,405 | B2 | 4/2007 | Le et al. | |
| 7,232,164 | B2 * | 6/2007 | Lee | 292/336.3 |
| 7,481,468 | B2 * | 1/2009 | Merideth et al. | 292/137 |
| 7,635,151 | B2 * | 12/2009 | Rodawold et al. | 292/336.3 |
| 2002/0008389 | A1 * | 1/2002 | Nomura et al. | 292/336.3 |
| 2007/0284894 | A1 | 12/2007 | Rodawold et al. | |

* cited by examiner

*Primary Examiner* — Carlos Lugo
*Assistant Examiner* — Alyson M Merlino
(74) *Attorney, Agent, or Firm* — Mark W. Croll; Paul F. Donovan

(57) ABSTRACT

An inertia activated mechanism associated with a door latch mechanism of a vehicle obstructs operation of a door handle assembly when the inertia activated mechanism is subjected to acceleration forces from a vehicle event. Delaying structure in the inertia activated mechanism momentarily delays return to the pre-event condition during rapidly changing acceleration of the vehicle event.

20 Claims, 5 Drawing Sheets

DELAY APPARATUS FOR OPENING OF VEHICLE DOOR

CROSS-REFERENCE TO RELATED APPLICATIONS

The present regular application claims the benefits of U.S. Provisional Application Ser. No. 61/040,771, filed Mar. 31, 2008.

FIELD OF THE INVENTION

The present invention relates generally to mechanisms adapted to prevent the undesirable opening of a vehicle door during a vehicle event such as a rollover, a crash or other abrupt movement; and, more particularly, the invention relates to structure in such a mechanism to delay return of the mechanism to the pre-event position for operation of the handle to open the vehicle door.

BACKGROUND OF THE INVENTION

During a collision, rollover or other abrupt event, a vehicle can be subjected to abruptly changing forces from various different directions, and can be subjected to both positive and negative gravitational forces with rapid acceleration and deceleration. The forces travel throughout the vehicle body and can travel from the door panel to the door handle in what can be characterized as a ripple effect.

It is desirable that the vehicle doors remain closed during a severe vehicle event such as a collision or rollover. Some door latch mechanisms can operate unintentionally when subjected to high acceleration under varying positional orientations, or to the ripple effect of forces that can occur during a crash or other severe vehicle event. Accordingly, it is known to provide lockout mechanisms of various types to prevent the unintended operation of the door latch mechanism during a severe vehicle event. Counterweights positioned opposite to the pivot of the door handle can be effective against side impact forces; however, during a rollover or other such complex, multiple axis event the counterweight can become positioned so as to allow latch operation. Counterweight systems also tend to be bulky, requiring significant space. Further, counterweight systems operate effectively only to a limited acceleration as determined from the design of the system. If the acceleration during an event exceeds the designed limit, the counterweight system is not effective in preventing the door from opening.

Another known design, referred to as an inertia activated mechanism, locks out operation of the latch handle mechanism even as the forces change during a severe vehicle event. Inertia activated mechanisms have been effective against the complex, rapidly changing force patterns experienced in rollovers and other such events in that the inertia activated mechanism operates initially regardless of the direction applied force. Further, inertia activated mechanisms remain effective even under severe acceleration and are not limited by the magnitude of acceleration.

During some severe vehicle events, abruptly changing inertial forces can rapidly change from positive to negative gravitational force and can rapidly change direction. An inertia activated mechanism rapidly changing in orientation and position can momentarily pass through a position in which the mechanism can return to its standard position for door latch mechanism operation. While such positioning can be brief, it is desirable to delay the return of the inertia activated mechanism to its latch operational position so that unintended vehicle door opening does not occur if the mechanism momentarily passes through the original orientation.

Accordingly, there is a need for improved vehicle latch lockout mechanisms that maintain operational lockout of the latch mechanism even under severe, multi-access vehicle events such as vehicle crashes and rollovers.

SUMMARY OF THE INVENTION

The present invention provides an inertia activated mechanism that inhibits vehicle door latch mechanism operation during severe vehicle events and includes structure that delays the inertia activated mechanism from returning to a home position at which the vehicle latch mechanism can be operated through movement of the door handle.

In one aspect of one form thereof, the present invention provides an inertia activated mechanism coupled to a door latch mechanism in a door of a vehicle, the door latch mechanism having a moving component that is moved to unlatch the door. The inertia activated mechanism has a housing defining a window, and a bar slidable in the housing and extending outwardly from the window. A tether movable in the housing has an end connected to the bar. A spring biases the bar to a home position. A weight connected to an opposite end of the tether from the end connected to the bar is movable relative to the housing and the tether from acceleration forces experienced during a vehicle event. Movement of the weight causes movement of the bar from the home position to an active position. The bar is disposed in a non-interfering position relative to the moving component of the door latch mechanism when the bar is in the home position, and is disposed in an interfering position relative to the moving component of the door latch mechanism when the bar is in the active position. The housing and the bar define delaying structure for delaying return of the bar to the home position from the active position.

In another aspect of another form thereof, the present invention provides an inertia activated mechanism that resists unlatching of a door of a vehicle during a vehicle event, with a housing defining a window, a weight and a bar movable in the housing and extending outwardly from the window. The bar prevents a pivoting cam of a door latch mechanism from rotating when a vehicle event force is applied to the weight and the bar is in an active position. A tether attaches to the weight to the bar. A spring restrains the weight and the bar in a home position when a vehicle event force is absent and urges the bar and the weight to the home position from the active position. The weight is displaced relative to the housing when a vehicle event force is applied to the assembly, the weight moving the bar to the active position. A delaying feature momentarily delays return of the bar to the home position from the active position during changing forces of a vehicle event.

In a still further aspect of the still further form thereof, the present invention provides a door latch mechanism that resists unlatching of a vehicle door during an event of an associated vehicle. The door latch mechanism has a door handle assembly including a pivoting cam that moves to unlatch the vehicle door, and an inertia activated mechanism including a housing, a weight that is displaced from a home position when a force from the event is applied to the weight; a spring that restrains the weight to the home position when the force is not applied; a bar that prevents the pivoting cam from rotating when the bar engages the pivoting cam; and a cable that attaches to the weight and to the bar and that causes the bar to engage the cam when the weight component is displaced Delaying structure in the inertia activated mechanism delays return of the bar to the home position from the active position when the weight returns to the home position.

An advantage of the present invention, in at least one form thereof, is providing a vehicle latch mechanism that remains latched during severe vehicle events that result in abruptly changing forces on the latch mechanism.

Another advantage of the present invention in at least one form thereof is providing an inertia activated mechanism with a delay feature to delay return of the inertia activated mechanism to a home position for latch operation.

Still another advantage of the present invention in at least one form thereof is providing in inertia activated mechanism with a delay feature that is both simple and reliable.

Other features and advantages of the invention will become apparent to those skilled in the art upon review of the following detailed description, claims and drawings in which like numerals are used to designate like features.

Figure 1:
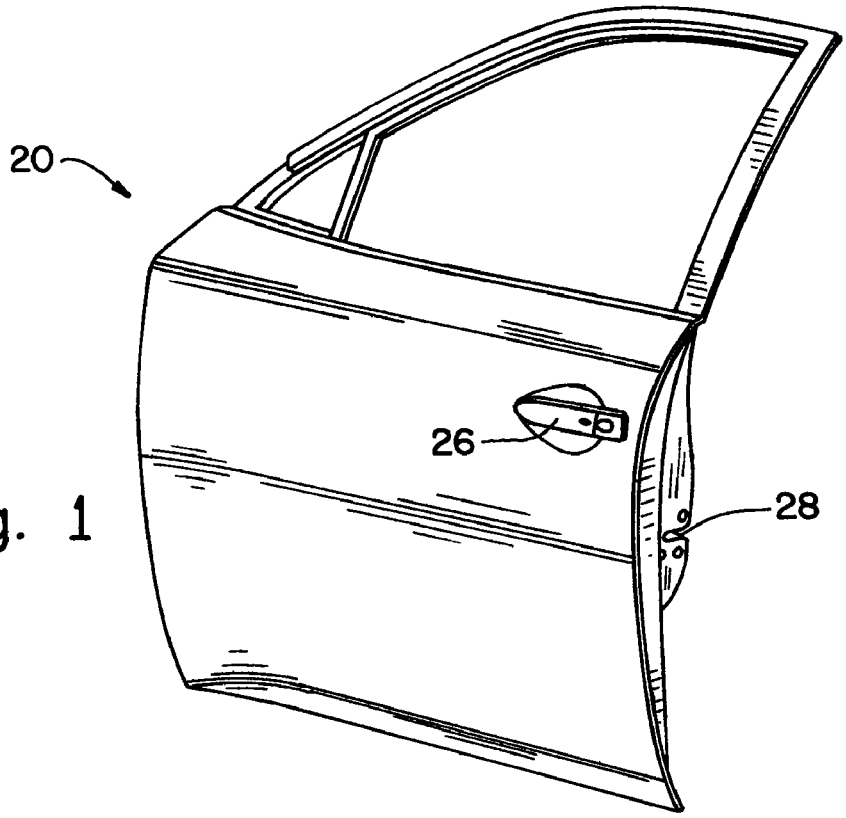
FIG. 1 is a perspective view of an automobile door having an inertia activated lockup mechanism including a delay apparatus in accordance with the present invention.
Figure 2:
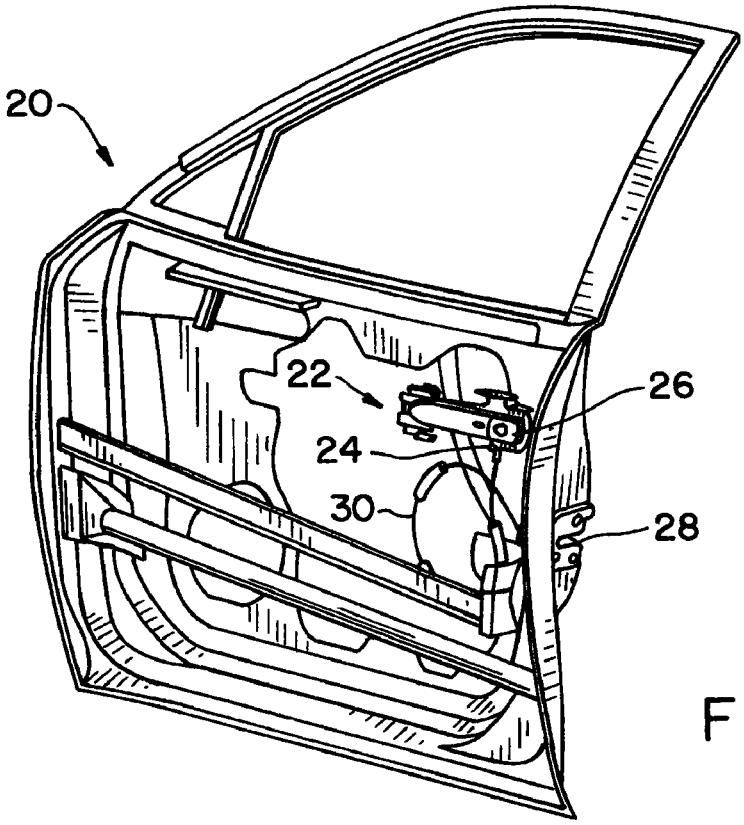
FIG. 2 is a perspective view of the vehicle door shown in FIG. 1, but with the outer body panel removed from the door to expose the door latch mechanism.
Figure 3:
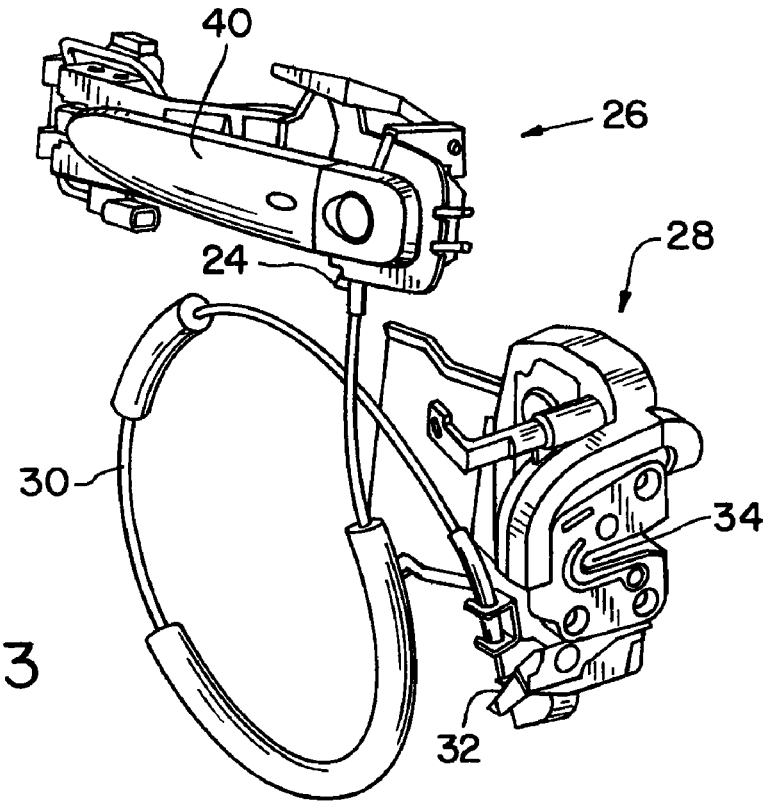
FIG. 3 is an enlarged perspective view of the door latch mechanism shown in FIG. 2.
Figure 4:
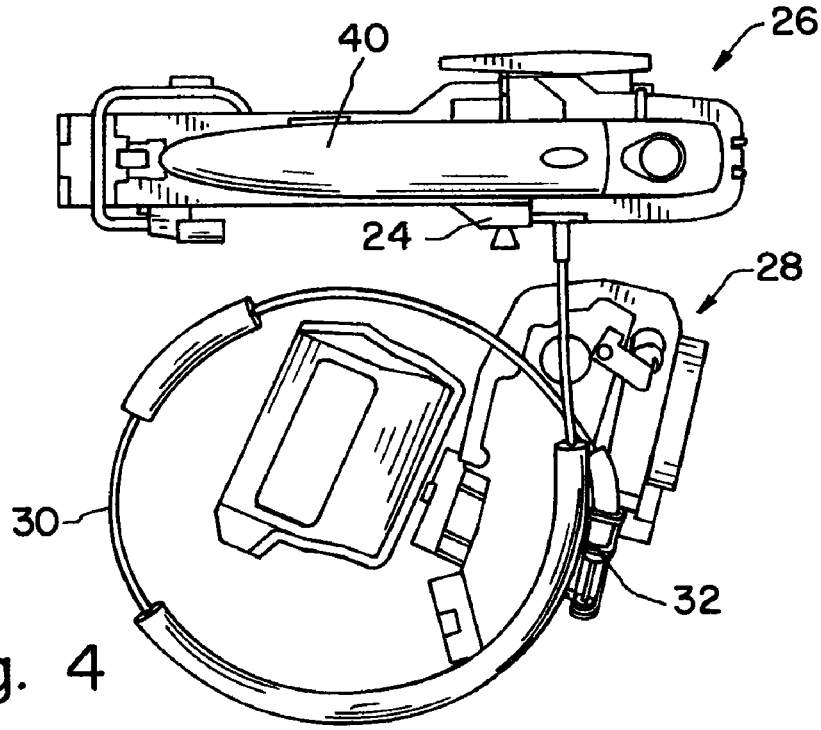
FIG. 4 is a view of the door latch mechanism shown in FIG. 3, but illustrating the mechanism from a different angle.
Figure 5:
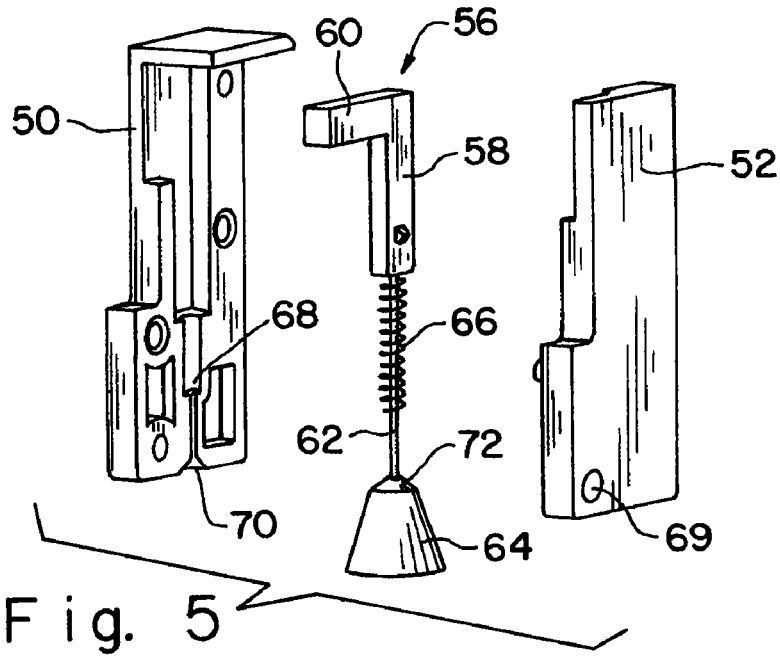
FIG. 5 is an exploded view of the inertia activated mechanism with a delay feature in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a vehicle door 20 is shown having an exemplary vehicle door latch mechanism 22 for latching and unlatching the door. An inertia activated mechanism 24, having a delay feature in accordance with the present invention, is provided as an operational part of door latch mechanism 22, as will be described in further detail hereinafter. Inertia activated mechanism 24 inhibits the operation of door latch mechanism 22 under forces experienced during severe vehicle events, including rapidly changing acceleration from multiple axes that occur during some such events, and delays returning to its pre-event state.

It should be understood that the present invention can be used in different types of inertia activated mechanisms and can be incorporated into door latch mechanisms of different types. The specific components shown and described herein are merely exemplary in nature.

Door latch mechanism 22 includes a handle assembly 26 having an operational component exposed in the exterior surface of door 20 and a latch assembly 28 that is selectively latched to and unlatched from an associated component in a vehicle door post (not shown). Handle assembly 26 and latch assembly 28 are operationally interconnected by a cable 30. In the exemplary embodiment, inertia activated mechanism 24 is associated with the operation of handle assembly 26 to inhibit operation thereof under the aforedescribed severe vehicle events.

Latch assembly 28 includes a latch lever 32 connected to cable 30 and additional levers, springs, cams and the like (not specifically identified) for the operation of a latch 34. Latch assembly 28 as shown and described herein is merely exemplary in nature, and the present invention can be used with a variety of different latch assemblies in vehicles of different types. Those skilled in the art will readily understand the design and operation of latch assemblies such as latch assembly 28, which will not be described in further detail herein.

Handle assembly 26 includes a handle 40 by which latch mechanism 22 is operated. In the exemplary embodiment shown, handle 40 is a horizontal, elongated body pulled or lifted outwardly or upwardly by the user for purposes of releasing latch 34 and opening door 20. Again, the specific structure, orientation and configuration of handle assembly 26 is merely exemplary and handle assemblies of other types and configurations can be used in conjunction with the present invention.

Handle assembly 26 further includes a cam assembly 42 that is rotated by movement of handle 40. Cam assembly 42 includes a shaft 44 and a cam 46 rotated thereby. Cam 46 travels along an arcuate path as door handle assembly 26 is operated, and the operation thereof is transmitted via cable 30 to latch assembly 28 for releasing latch 34 and allowing door 20 to open. The operation of door handle assembly 26 and latch assembly 28 via the interconnection of cable 30 is understood by those skilled in the art and will not be described in further detail herein.

Inertia activated mechanism 24 is associated with handle assembly 26 to provide an impediment in the path of travel of cam 46 under the aforedescribed severe vehicle events, to thereby disrupt operation of handle assembly 26 and prevent operation of latch assembly 28 to retain door 20 in a latched condition even if forces experienced in a severe vehicle event urge door latch mechanism 22 to an unlatched state.

Figure 6:
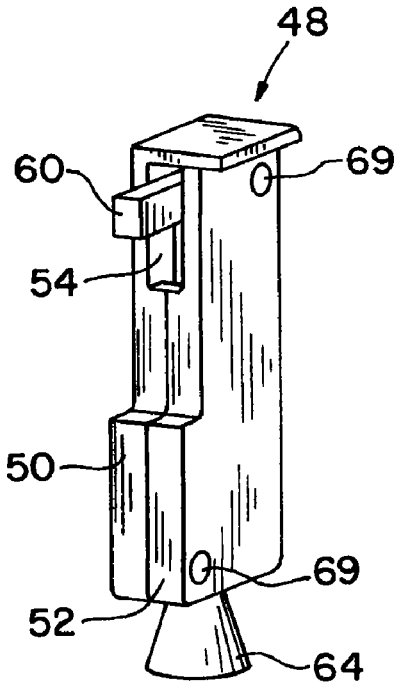
FIG. 6 is a perspective view of the assembled inertia activated mechanism shown in FIG. 5.
Figure 7:
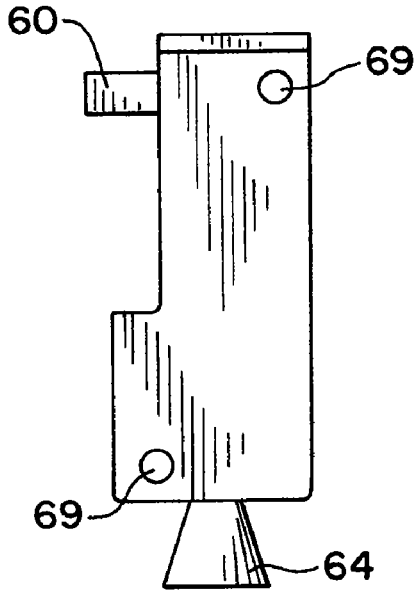
FIG. 7 is an elevational side view of the inertia activated mechanism shown in FIG. 6.

Inertia activated mechanism 24 includes a housing 48 having first and second housing parts 50 and 52. In the assembled configuration thereof, housing parts 50, 52 define a window 54 along a side of housing 48. A bar 56 slidable in housing parts 50, 52 projects outwardly from window 54. Bar 56 in the exemplary embodiment is of a substantial L-shaped configuration, having a vertical segment 58 within housing parts 50, 52 and a horizontal segment 60 which projects outwardly from window 54. A tether 62, such as a cable, string, cord or the like, is attached at one end to vertical segment 58 of bar 56 and at an opposite end to a weight 64. Tether 62 is movable in housing 48. Weight 64 in the exemplary embodiment is bell-shaped. Attachment of tether 62 to bar 56 and weight 64 can be by insert molding, crimping, fastening, bonding with adhesives, or other suitable means. A coil spring 66 is disposed between and operational against an end of vertical segment 58 and a ledge 68 within the housing. Tether 62 extends through spring 66. Extension or outward movement of tether 62 compresses spring 66 as the end of vertical segment 58 of bar 56 is drawn closer to ledge 68. Accordingly, spring 66 is disposed between and operates against the end of vertical segment 58 and ledge 68, to urge bar 56 to the upward or home position as shown in FIG. 6.

Housing 48 is configured to mount into handle assembly 26 such as by fasteners (not shown) mounted through mounting holes 69. Tether 62 and weight 64 suspended from bar 56. Spring 66 urges bar 56 upwardly as shown in FIG. 6, whereby horizontal segment 60 of bar 56 is positioned above the arcuate path traveled by cam 46 during operation of door latch mechanism 22.

Housing 48 can be provided with a concave depression 70 at the outlet thereof through which tether 62 extends. Depression 70 receives a complementarily shaped dome 72 of bell-shaped weight 64. In the home or non-activated position of inertia activated mechanism 24, bar 56 is urged upwardly by spring 66 such that tether 62 is taut between vertical segment 58 and weight 64, and dome 72 of weight 64 is nestled in and held against depression 70.

Figure 8:
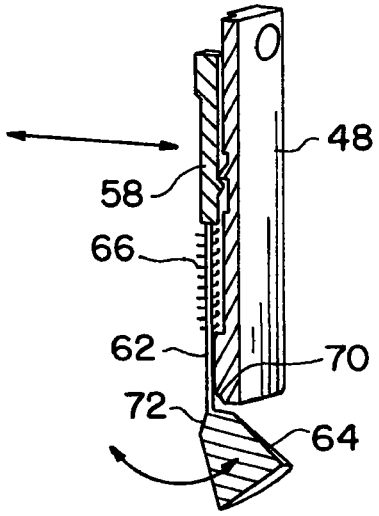
FIG. 8 is a cross sectional view of the inertia activated mechanism illustrated in an activated position.
Figure 9:
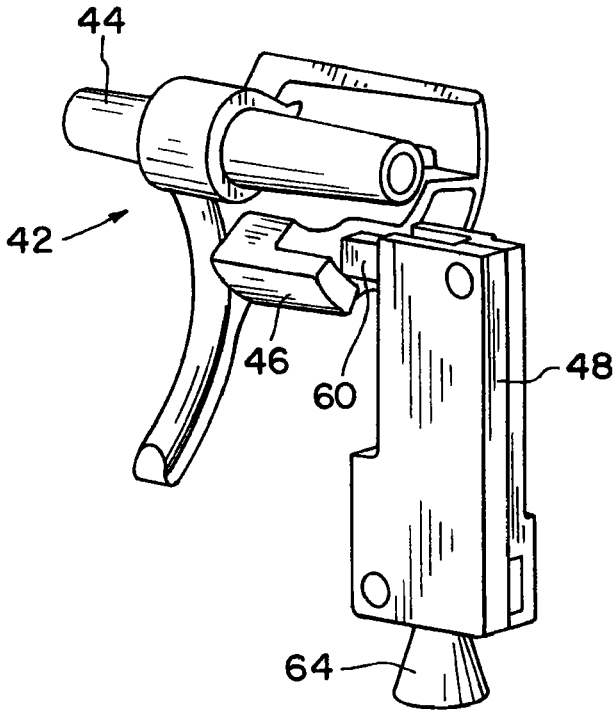
FIG. 9 is a further perspective view of a portion of the door handle mechanism, illustrating the inertia activated mechanism in a non-activated state.
Figure 10:
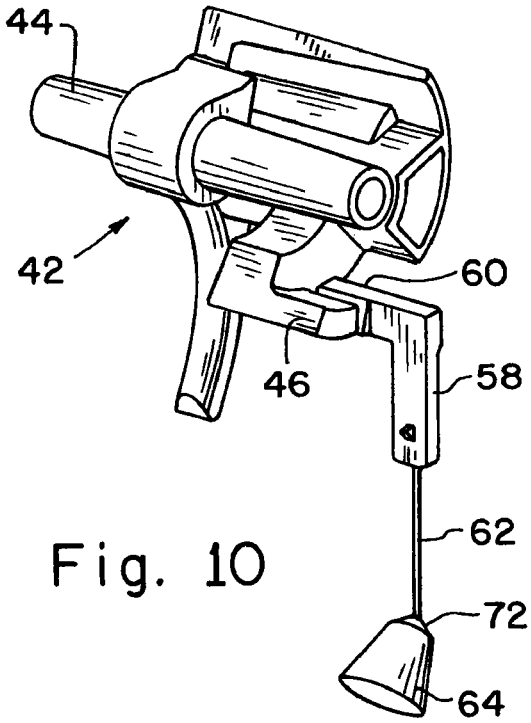
FIG. 10 is a perspective view illustrating the door handle mechanism of FIG. 9, but with the inertia activated mechanism in an activated position preventing handle mechanism operation, and the housing removed for illustration purposes.
Figure 11:
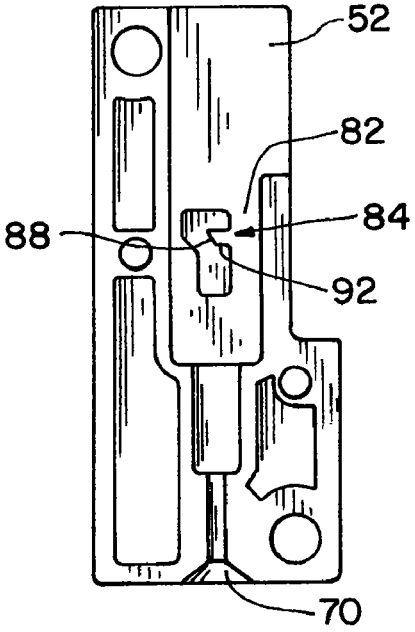
FIG. 11 is an elevational view of one housing part for the inertia activated mechanism.
Figure 12:
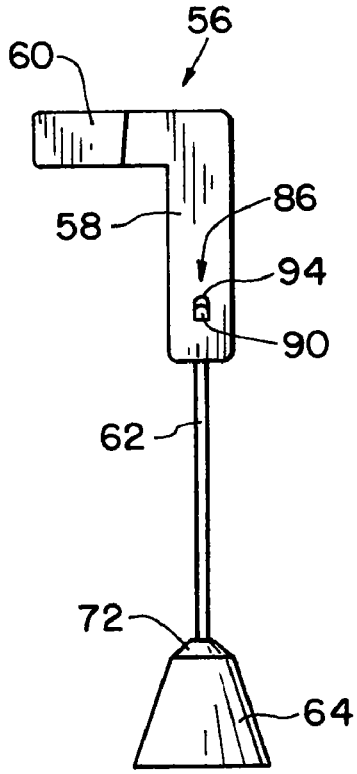
FIG. 12 is a plan view of internal parts of the inertia activated mechanism.
Figure 13:
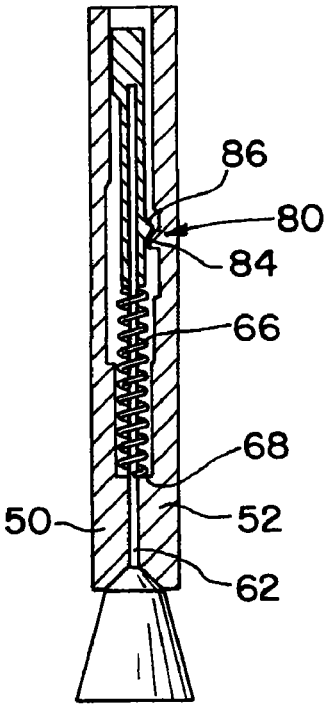
FIG. 13 is a cross-sectional view of the inertia activated mechanism in a non-activated state.
Figure 14:
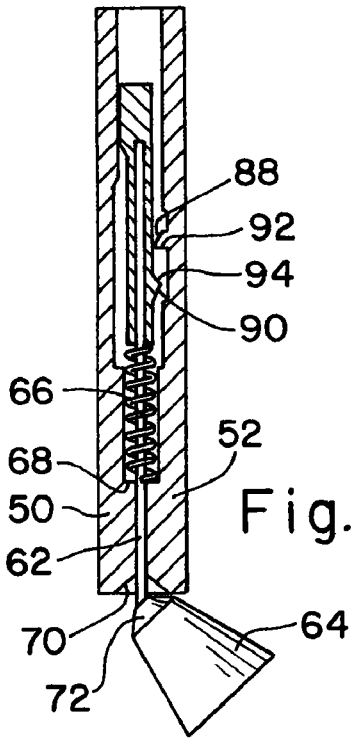
FIG. 14 is a cross-sectional view of the inertia activated mechanism in an activated state.

During a vehicle event of sufficient force, such as a roll-over, vehicle impact or the like, the rapid acceleration forces reaching door 20 and door latch mechanism 22 can disrupt the aligned relationship of weight 64 relative to housing 48, whereby the spring force of spring 66 is overcome, and dome 72 and depression 70 are tilted relative to one another, as shown in FIG. 8. This relative movement between weight 64 and housing 48 causes outward movement of tether 62 relative to housing 48, thereby pulling bar 56 downwardly and moving horizontal segment 60 downwardly in window 54. Horizontal segment 60 this activated state is thereby positioned in the arcuate path traveled by cam 46 and provides an impediment to movement of cam 46. Accordingly, as illustrated in FIG. 10, cam 46 and shaft 44 are held in position and constrained against further rotation, whereby latch assembly 28 remains in the latched condition, and door 20 is not released for opening. When the acceleration forces diminish, spring 66 provides sufficient spring force to urge bar 56 toward the home or non-activated position, whereby horizontal segment 60 no longer interferes with the rotation of cam 46, and door latch mechanism 22 can again be operated through door handle assembly 26 connected to latch assembly 28.

During a severe vehicle event, as door latch mechanism 22 is subjected to abruptly changing forces from multiple axes, weight 64 can move abruptly from one position to another with respect to housing 48. During some such movements, weight 64 can align briefly with housing 48 in an orientation in which spring 66 could urge bar 56 to the home position. Such could cause instantaneous unlatch, even as the vehicle event continues. To prevent unintended door unlatch in such a situation, delaying structure 80 is provided in inertia activated mechanism 24 to delay the travel of bar 56 to the home position. This brief delay retains door latch mechanism 22 incapable of operation as weight 64 passes to yet another orientation overcoming force from spring 66. However, the delay is only brief, and when the vehicle event ends and acceleration forces diminish, latch mechanism 22 quickly returns to an operable state.

Delaying structure 80 includes a track 82 defined in housing 48 to guide the movement of bar 56 therein. A protrusion 84 is provided in track 82, which may be formed in one of the housing parts 50, 52. A cooperating protrusion 86 is provided on bar 56, and in the exemplary embodiment is provided on vertical segment 58 thereof. Cooperating protrusions 84, 86 have sloped surfaces 88, 90, respectively, confronting one another when inertia activated mechanism 24 is in the home position. Sloped surfaces 88, 90 are angled such as to provide minimal resistance to sliding movement of one past the other, and therefore minimally resist movement of inertia activating mechanism 24 from the non-active state or home position to an active state of the mechanism. Blunt surfaces 92, 94 of protrusions 84, 86 are provided on sides of the protrusions opposite to sloped surfaces 88, 90. Blunt surfaces 92, 94 confront one another when spring 66 urges bar 56 to the home position from the active state. The blunt, confronting relationship momentarily delays the movement of bar 56 to the home position in that the bar must move laterally and does not do so as quickly in the return direction due to the blunt, confronting relationship of blunt surfaces 92, 94. If acceleration forces continue during the event, the momentary delay is sufficient to hold inertia activated mechanism 24 in the active condition as weight 64 moves to yet another skewed position relative to housing 48. When all such acceleration forces terminate at the conclusion of the vehicle event, protrusions 84, 86 readily move one past another to return bar 56 to the home position at which door latch mechanism 22 is operable to unlatch and open door 20.

Terms used herein such as "up" or "upwardly", "down" or "downwardly", "above", "below" and the like are used with respect to the orientation of the exemplary embodiment depicted in the drawings. It should be understood that the present invention can be used in orientations other than that shown, such as, for example, with weight 64 above housing 48 and window 54 with horizontal segment 60 of bar 56 protruding therefrom at a lower portion of housing 48; or in a generally horizontal orientation.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An inertia activated mechanism coupled to a handle assembly of a door latch mechanism in a door of a vehicle, the handle assembly having a moving component that is moved to unlatch the door, the inertia activated mechanism comprising:

a housing defining a window;

a bar slidable in said housing and extending outwardly from said window;

a tether movable in said housing and having an end connected to said bar;

a spring biasing said bar to a home position;

a weight connected to an opposite end of said tether from said end connected to said bar, said weight and said tether being movable relative to said housing from acceleration forces experienced during a vehicle event, movement of said weight and said tether causing movement of said bar from said home position to an active position;

said bar disposed in a non-interfering position relative to the moving component of the handle assembly when said bar is in said home position, and disposed in an interfering position relative to the moving component of the handle assembly in the active position, to impede operation of the handle assembly upon the inertia activated mechanism being activated by the vehicle event; and said housing and said bar defining a delaying structure for delaying movement of said bar during return of said bar to said home position from said active position relative to movement of said bar from said home position to said active position.

2. The inertia activated mechanism of claim 1, said delaying structure comprising confronting protrusions on said bar and said housing interfering one with the other for delaying the return of said bar to said home position.

3. The inertia activated mechanism of claim 2, said bar being L-shaped.

4. The inertia activated mechanism of claim 2, said protrusions having blunt surfaces confronting one another as said bar returns to said home position from said active position.

5. The inertia activated mechanism of claim 4, said protrusions having sloped surfaces sliding one past another as said bar moves to said active position from said home position.

6. The inertia activated mechanism of claim 5, said weight having a dome and said housing having a depression of complementary shape to said dome, and said dome being nestled in said depression in said home position.

7. The inertia activated mechanism of claim 1, said weight having a dome and said housing having a depression of complementary shape to said dome, and said dome being nestled in said depression in said home position.

8. The inertia activated mechanism of claim 1, said delaying structure comprising a track defined on said housing, said bar having a segment sliding in said track, and protrusions on said bar and in said track interacting one with the other to delay the return of said bar to said home position.

9. The inertia activated mechanism of claim 1, further comprising structures on said bar and said housing configured and arranged to enable more rapid movement of said bar away from said home position to said active position than to said home position from said active position independent of the strength of changing acceleration during the vehicle event.

10. The inertia activated mechanism of claim 9, said structures on said bar and said housing being protrusions having sloping surfaces confronting one another as said bar moves from said home position to said active position, and blunt surfaces confronting one another as said bar moves from said active position to said home position.

11. An inertia activated mechanism that resists unlatching of a door of a vehicle during a vehicle event, comprising:

a housing defining a window;

a weight;

a bar movable in the housing and extending outwardly from the window, the bar preventing a pivoting cam of a handle assembly in a door latch mechanism from rotating when a vehicle event force is applied to the weight and the bar is moved into an active position;

a tether that attaches the weight to the bar;

a spring that restrains the weight and the bar in a home position when the vehicle event force is absent and urges the bar and the weight to the home position from the active position;

the weight being displaced relative to the housing when the vehicle event force is applied, the weight moving the bar to the active position; and a delaying structure momentarily delaying movement of the bar during the return of the bar to the home position from the active position from changing forces of the vehicle event relative to movement of said bar from said home position to said active position.

12. The inertia activated mechanism of claim 11, said delaying structure comprising protrusions on said housing and said bar that slide past one another as the bar moves between the active and home positions, the protrusions providing a greater obstruction to movement of the bar from the active position to the home position than from the home position to the active position.

13. The inertia activated mechanism of claim 12, the protrusions having sloped surfaces confronting one another when the bar moves from the home position to the active position and blunt surfaces confronting one another when the bar moves from the active position to the home position.

14. The inertia activated mechanism of claim 13, the housing defining a track, one of the protrusions disposed in the track; and the bar having a segment slidable in the track, the segment of the bar having the other of the protrusions thereon.

15. The inertia activated mechanism of claim 11, the weight having a dome and the housing having a depression of complementary shape to the dome, and the dome being nestled in the depression in the home position.

16. A door latch mechanism that resists unlatching of a vehicle door during an event of an associated vehicle, comprising:

a door handle assembly including a pivoting cam that moves to unlatch the vehicle door;

an inertia activated mechanism including a housing and a weight that is displaced from a home position when a force from the event is applied to the weight;

a spring that restrains the weight in the home position when the force is not applied;

a bar that prevents the pivoting cam from rotating when the bar engages the pivoting cam, thereby preventing the unlatching of the vehicle door;

a cable that attaches to the weight and to the bar, and that causes the bar to engage the cam when the weight component is displaced; and a delaying structure in the inertia activated mechanism delaying the return of the bar to the home position from the active position when the weight returns to the home position relative to movement of said bar from said home position to said active position when the weight is displaced from the home position.

17. The door latch mechanism of claim 16, said delaying structure comprising protrusions on said housing and said bar configured and positioned so as to move more readily one past the other as the bar moves from the home position to the active position than when the bar moves from the active position to the home position.

18. The door latch mechanism of claim 17, the protrusions having sloping surfaces sliding one past the other as the bar moves from the home position to the active position.

19. The door latch mechanism of claim 17, the protrusions having blunt surfaces confronting one another as the bar moves from the active position to the home position.

20. The door latch mechanism of claim 16, the weight having a dome and the housing defining a depression, the dome being nestled in the depression in the home position.

* * * * *